US012174000B2

(12) United States Patent
Poston

(10) Patent No.: US 12,174,000 B2
(45) Date of Patent: Dec. 24, 2024

(54) JACKETED ARCHERY ARROW INSERT SYSTEM FOR ARROWS

(71) Applicant: Seth Aaron Poston, Burlington, KY (US)

(72) Inventor: Seth Aaron Poston, Burlington, KY (US)

( * ) Notice: Subject to any disclaimer, the term of this patent is extended or adjusted under 35 U.S.C. 154(b) by 83 days.

(21) Appl. No.: 18/193,453

(22) Filed: Mar. 30, 2023

(65) Prior Publication Data

US 2023/0314109 A1 Oct. 5, 2023

Related U.S. Application Data

(60) Provisional application No. 63/325,493, filed on Mar. 30, 2022.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 4,671,517 | A * | 6/1987 | Winters | F42B 6/08 403/165 |
| 5,269,534 | A * | 12/1993 | Saunders | F42B 6/08 473/582 |
| 7,270,618 | B2 * | 9/2007 | Palomaki | F42B 6/04 473/578 |
| D581,006 | S | 11/2008 | Smith et al. | |
| 7,651,421 | B2 * | 1/2010 | Smith | F42B 6/08 473/582 |
| 8,016,703 | B1 * | 9/2011 | Kronengold | F42B 6/08 473/582 |
| D658,737 | S | 5/2012 | Giles et al. | |
| D659,218 | S | 5/2012 | Palomaki et al. | |
| 9,410,773 | B2 * | 8/2016 | Greenwood | F42B 6/08 |
| 9,658,037 | B2 * | 5/2017 | James | F42B 6/04 |
| 9,739,581 | B2 * | 8/2017 | Zobell | F42B 6/08 |
| 11,022,413 | B1 * | 6/2021 | Broderick | F42B 6/08 |
| 2017/0299353 | A1 * | 10/2017 | Greenwood | F42B 6/04 |
| 2019/0265007 | A1 * | 8/2019 | Gizowski | F42B 6/08 |

FOREIGN PATENT DOCUMENTS

| | | | |
|---|---|---|---|
| WO | 2005038384 | A2 | 4/2005 |
| WO | 2005106380 | A2 | 11/2005 |

* cited by examiner

*Primary Examiner* — John A Ricci

(57) ABSTRACT

A jacketed archery arrow insert system for an arrow includes a sleeve, a torque dissipation rod insert, and an arrow shaft. The torque dissipation rod insert includes a collar section, a first tail section, and a second tail section. The collar section and the second tail section are oppositely positioned of each other about the first tail section. The collar section is adjacently connected and concentrically positioned to the first tail section. The second tail section is adjacently connected and concentrically positioned to the first tail section. The second tail section is internally mounted to a shaft body of the arrow shaft as the first tail section and the collar section are externally positioned to the shaft body. The sleeve is externally mounted around the shaft body and the first tail section to protect the structural integrity of the torque dissipation rod insert and the arrow shaft.

18 Claims, 7 Drawing Sheets

JACKETED ARCHERY ARROW INSERT SYSTEM FOR ARROWS

The current application claims a priority to the U.S. provisional patent application Ser. No. 63/325,493 filed on Mar. 30, 2022.

FIELD OF THE INVENTION

The present invention relates generally to an archery arrow assembly that requires a transition insert to attach the arrow shaft to the screw-in point. More specifically, the present invention is a jacketed archery arrow insert system for an arrow so that the screw-in point transfers the tortional stress of impacts at angles less than 90-degree. The jacketed system protects the most vulnerable parts of the arrow, which are the threads, jacket to carbon interface, and the first outer diameter of the point.

BACKGROUND OF THE INVENTION

Traditional inserts for 0.204 inches (5.2 mm) inner diameter and smaller arrow shafts require a transition insert to make the removal of the arrow from targets easier without the use of unique field points or broadheads. The traditional way to accomplish this is with a one-piece insert that is utilized as the intermediate mounting body. More specifically, the one-piece insert is glued into an opened end of the arrow shaft so that the screw-in point can be threaded into the one-piece insert from the opposite end. Due to the lack of material about the connection point of the opened end of the arrow shaft and the one-piece insert, the arrow shaft is vulnerable to breakage when a significant moment arm occurs with a side impact.

It is an objective of the present invention to provide a jacketed archery arrow insert system so that opened end of the arrow shaft can be structurally strengthened to prevent breakage. More specifically, the present invention relates generally to an arrow that requires a transition from a smaller outer carbon or aluminum diameter (<0.310") to the standard diameter of most field points and broadheads (0.310"). The present invention strengthens the opened end of the arrow shaft with an internally attached insert and an externally attached sleeve so that the arrow shaft is able to withstand a larger force of moment arm without breakage. Protecting the opened end of the arrow shaft from breakage allows for lower cost of ownership, reliability, and greater protection from lost animals when used for hunting.

DETAIL DESCRIPTIONS OF THE INVENTION

All illustrations of the drawings are for the purpose of describing selected versions of the present invention and are not intended to limit the scope of the present invention.

Figure 1:
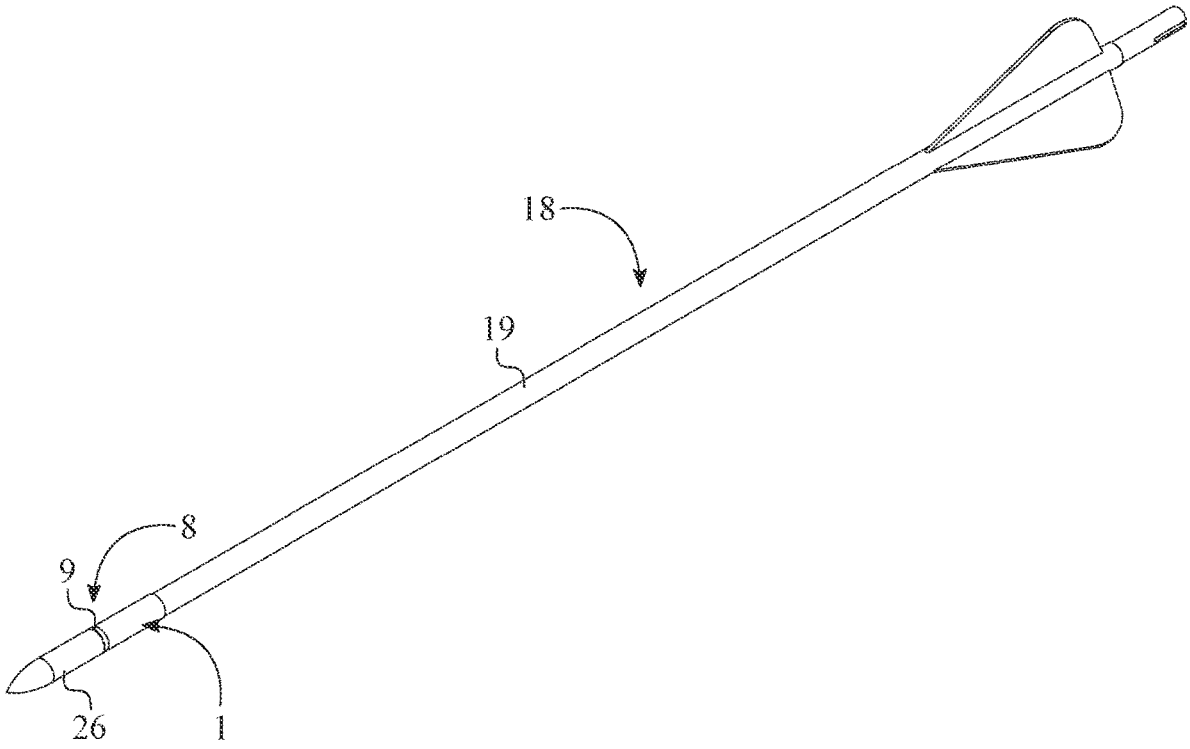
FIG. 1 is a perspective view of the present invention.
Figure 2:
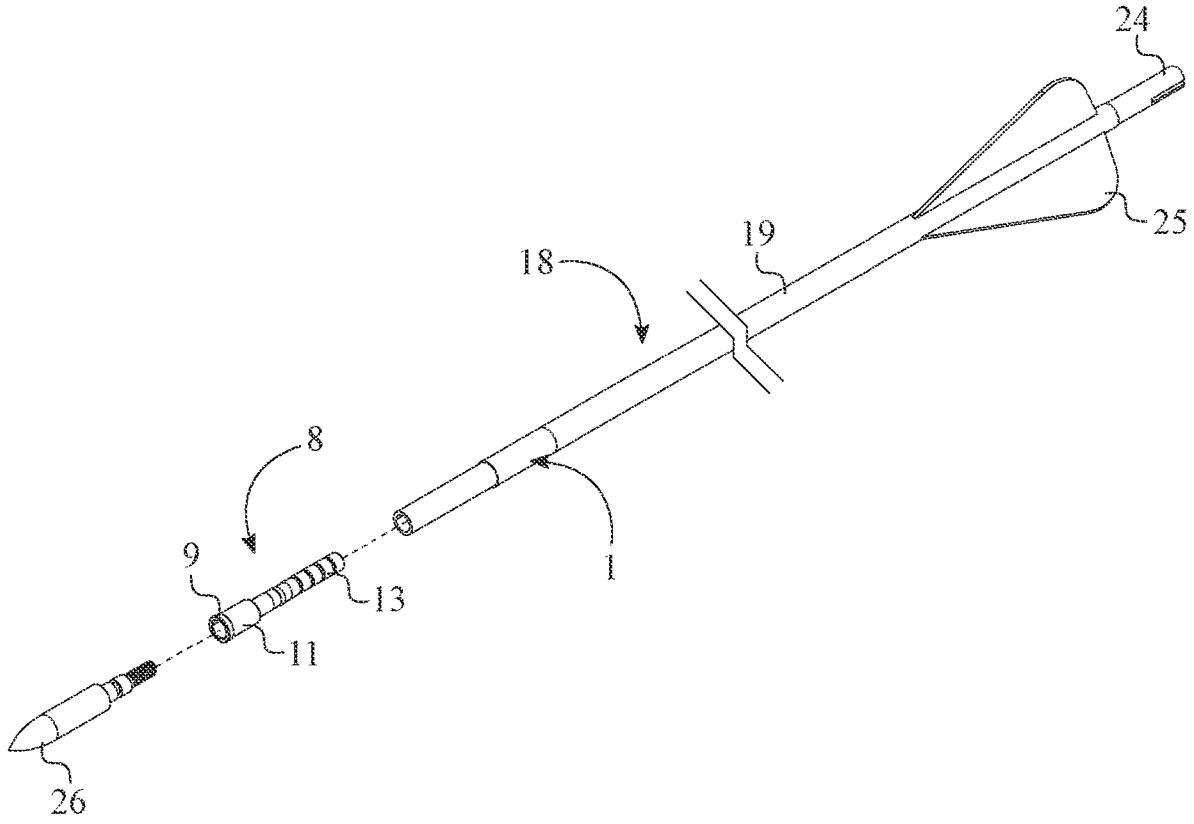
FIG. 2 is an exploded view of the present invention.

The present invention is a jacketed archery arrow insert system for an arrow to reduce the moment arm created by side impact and to structurally protect a front end of the arrow. In other words, the present invention strengthens the front end of the arrow with an internally attached insert and an externally attached tubular body so that the arrow is able to withstand a larger force of moment arm without breakage. The present invention comprises a sleeve 1, a torque dissipation rod insert 8, an arrow shaft 18, and a screw-in point 26 as shown in FIG. 1 and FIG. 2. Most of the existing archery arrow insert systems generally use a glued or screwed connection between the screw-in field points and the arrow thus exposing the front end of the arrow for potential breakage or bending. Some of existing archery arrow insert systems additionally introduce a front-inserted tubular body to further strengthen the glued or screwed connection between the screw-in field points and the arrow. However, the front-inserted tubular body is not able to eliminate large torsional force caused by a longer moment arm that occur during side impacts. The present invention is able to solve these problems by introducing the sleeve 1 that is inserted from a rear end of the torque dissipation rod insert 8 to structurally protect the arrow shaft 18 and the torque dissipation rod insert 8 against the side torsional forces caused by a large moment arm at impacts less than 90-degrees.

In reference to FIG. 2, the arrow shaft 18 comprises a shaft body 19, a launching mechanism 24 and a steering mechanism 25 and configured to industry standards and regulations. More specifically, the shaft body 19 is an elongated tubular body and provides the total length for the arrow shaft 18. The arrow shaft 18 is preferably made of carbon steel or any other similar materials such as aluminum, carbon, wood, composite, or an aluminum-carbon mixture. The launching mechanism 24 is terminally connected to a rear end the shaft body 19 so that the bowstring can fit in a slotted opening of the launching mechanism 24 to hold the bowstring in place. The steering mechanism 25 is externally mounted to the shaft body 19 and adjacently positioned to the launching mechanism 24 so that shaft body 19 can be stabilized during flight. More specifically, the steering mechanism 25 causes the arrow to spin during the flight as the spinning process keeps the arrow on its flight path and preserves speed, accuracy, and, ultimately, impact power. Even though the present invention is explained in relation to a nock as the launching mechanism 24 and a fletching as the steering mechanism 25, the present invention is not limited to the illustrated launching mechanism 24 and the illustrated steering mechanism 25 can be any other types of industry standard mechanisms or systems without deviating from the scope of the functionality. In reference to some embodiments of the present invention, the steering mechanism 25 can be replaced with any other types of steering mechanisms that can stabilized the shaft 19 during flight. In reference to some embodiments of the present invention, the launching mechanism 24 can be replaced with any other types of launching mechanisms that can hold the bowstring in place.

Figure 5:
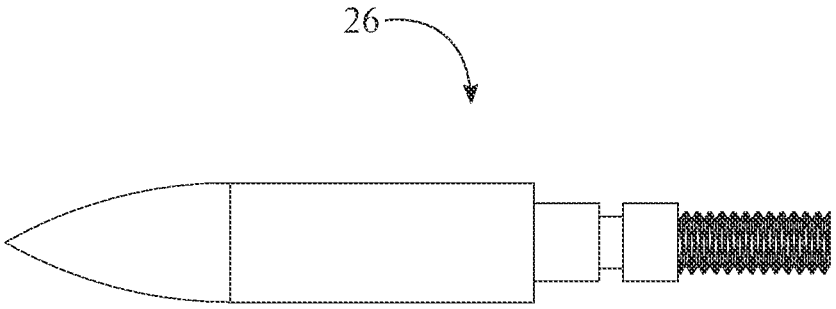
FIG. 5 is a side view of the screw-in point of the present invention.

In reference to FIG. 2 and FIG. 5, the screw-in point 26 is mounted to the shaft body 19 and generally configured as a sharpened and hardened tip so that the screw-in point 26 can penetrate into the target. Depending upon the purpose of the archery, the design of the screw-in point 26 can change with respect to industry standards and regulations. A threaded attachment is concentrically connected to the screw-in point 26 so that the threaded attachment can function as the fastening mechanism that engages with the torque dissipation rod insert 8.

Figure 4:
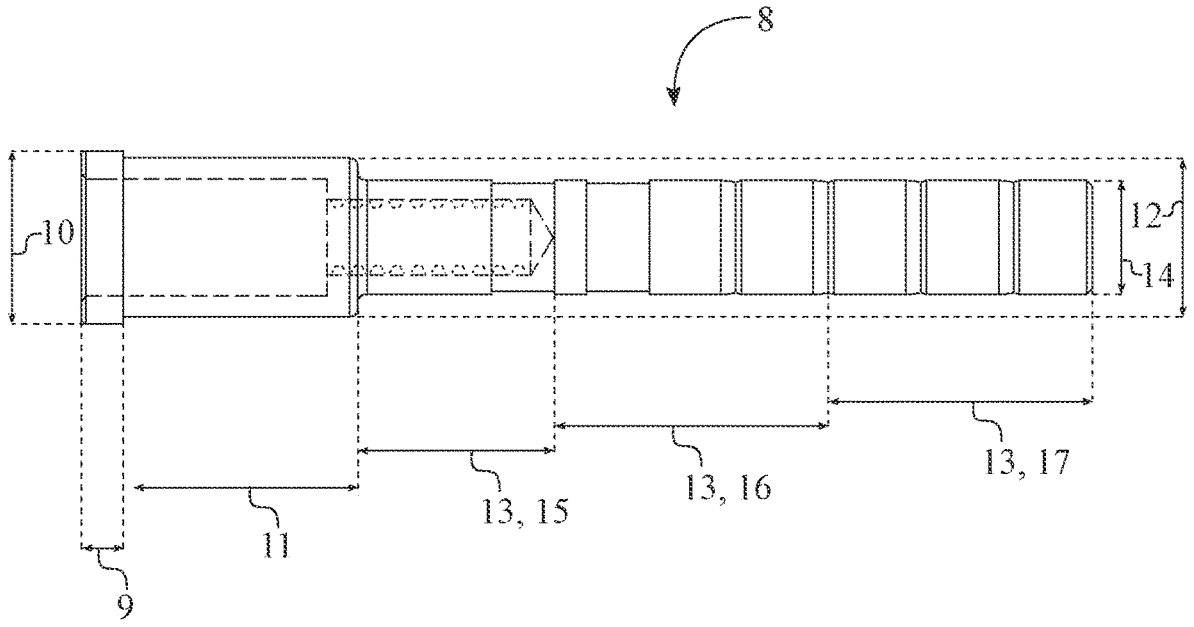
FIG. 4 is a side view of the torque dissipation rod insert of the present invention, wherein the internal dash lines illustrate the hidden surfaces.

In reference to FIG. 2 and FIG. 4, the torque dissipation rod insert 8 that secures the screw-in point 26 to the arrow shaft 18 comprises a collar section 9, a first tail section 11, and a second tail section 13. The collar section 9 and the second tail section 13 are oppositely positioned of each other about the first tail section 11. More specifically, the collar section 9 is adjacently connected to the first tail section 11 and concentrically positioned to the first tail section 11. The second tail section 13 is adjacently connected to the first tail section 11 and concentrically positioned to the first tail section 11. When the torque dissipation rod insert 8 is glued into the shaft body 19, the second tail section 13 is internally mounted to the shaft body 19 as the second tail section 13 fully enclosed by the shaft body 19. Resultantly, the first tail section 11 and the collar section 9 are externally positioned to the shaft body 19. The sleeve 1 is externally mounted around the shaft body 19 and the first tail section 11 thus structurally reinforcing the connection between the torque dissipation rod insert 8 and the shaft body 19.

Figure 3:
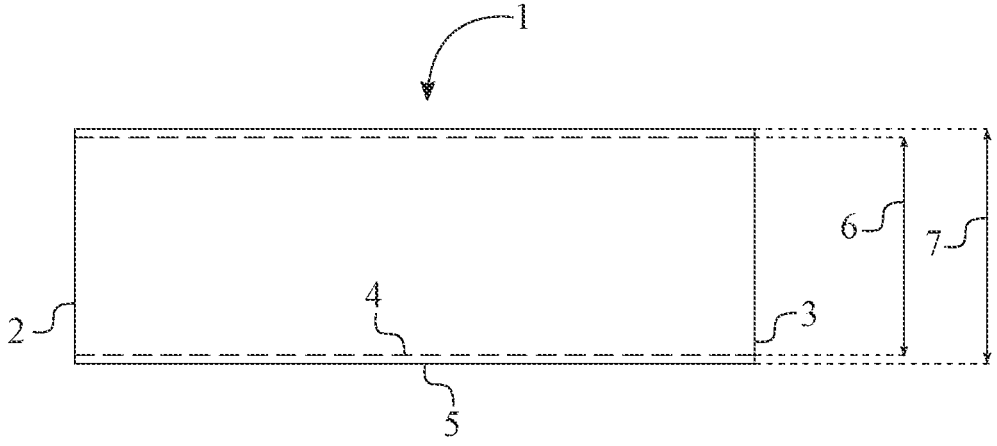
FIG. 3 is a side view of the sleeve of the present invention, wherein the internal dash lines illustrate the hidden surfaces.

In reference to FIG. 2 and FIG. 3, the sleeve 1 is a tubular body and may comprise a front edge 2 and a rear edge 3. Furthermore, the sleeve 1 has to be inserted around the shaft body 19 before the torque dissipation rod insert 8 is mounted to the shaft body 19 so that the sleeve 1 can be externally mounted around the shaft body 19 and the first tail section 11. When the sleeve 1 is slid into place within the assembly, the rear edge 3 is externally positioned around the arrow shaft 18 and the front edge 2 is positioned adjacent to the collar section 9 and externally positioned around the first tail section 11. In other words, the torque dissipation rod insert 8 and the sleeve 1 are oppositely positioned of the launching mechanism 24 about the shaft body 19 so that the screw-in point 26 can be threadedly attached into the first tail section 11 and the second tail section 13.

In reference to FIG. 4, the second tail section 13 may comprise a hollow portion 15, a proximal extension 16, and at least one distal extension 17. The proximal extension 16 is concentrically connected to the hollow portion 15. The distal extension 17 is concentrically connected to the proximal extension 16 and positioned opposite of the hollow portion 15. The screw-in point 26 is threadedly attached into the hollow portion as the proximal extension 16 and the distal extension 17 are positioned behind the screw-in point 26. For example, in order to threadedly attach the screw-in point 26, the threaded attachment of the screw-in point 26 first passes through collar section 9 and the first tail section 11 so that the threaded attachment can threadedly engage with the hollow portion 15. The proximal extension 16 and the distal extension 17 functions as weighted bodies so that the arrow can be balanced or configured upon user's preference. When the torque dissipation rod insert 8 is attached to the shaft body 19, the hollow portion 15, the first extension, and the second extension are internally positioned within the shaft body 19.

Figure 6:
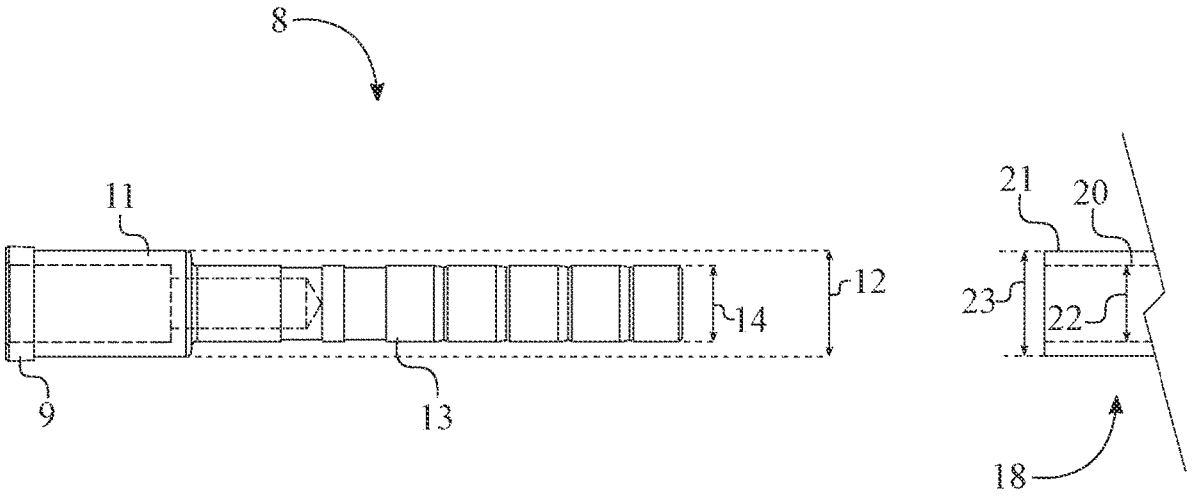
FIG. 6 is a side view of the torque dissipation rod insert and the shaft body of the present invention, wherein the internal dash lines illustrate the hidden surfaces.
Figure 7:
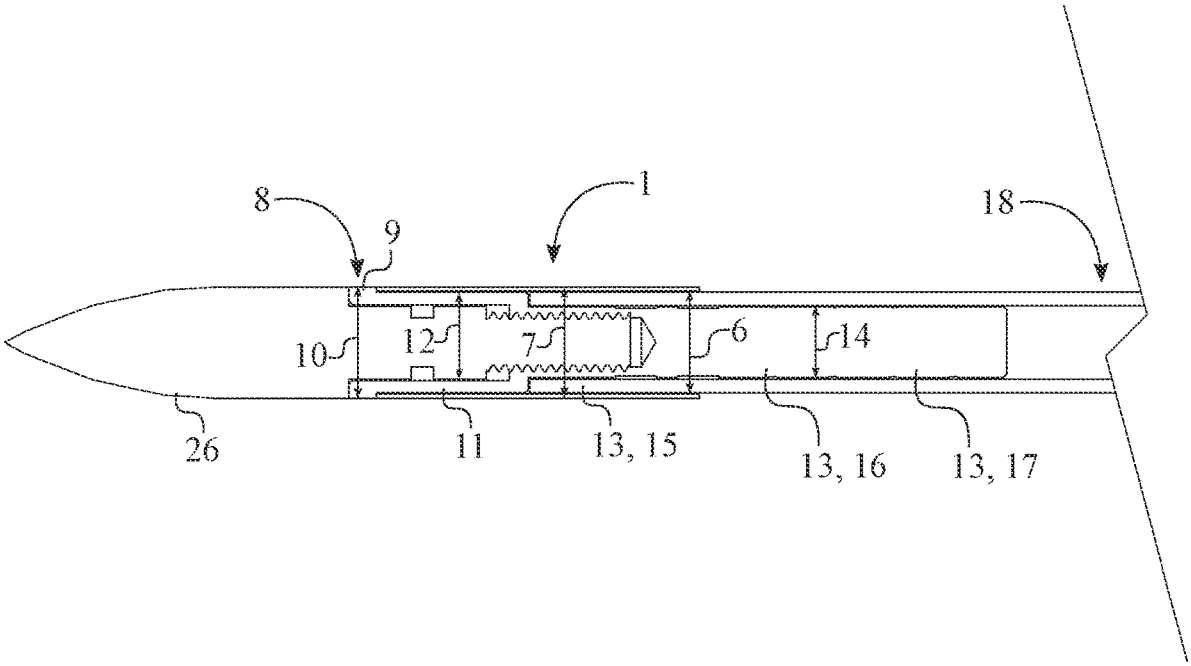
FIG. 7 is a schematic view of the present invention, showing the attachment between the shaft body, the torque dissipation rod insert, the sleeve, and the screw-in point.

In reference to FIG. 6 and FIG. 7, the present invention may further comprise a first outer diameter 12, a second outer diameter 14, and a third outer diameter 10. More specifically, the first outer diameter 12 is delineated about the first tail section 11. The second outer diameter 14 is delineated about the second tail section 13. The third outer diameter 10 is delineated about the collar section 9. In order to define the exact shape of the torque dissipation rod insert 8, the first outer diameter 12 is greater than the second outer diameter 14 and the third outer diameter 10 is greater than the first outer diameter 12. In other words, the first tail section 11 is a slightly larger cylindrical body than the second tail section 13, and the collar section 9 is a slightly larger cylindrical body than the first tail section 11.

In reference to FIG. 6 and FIG. 7, the present invention may further comprise an inner shaft-diameter 22 and an outer shaft-diameter 23. The inner shaft-diameter 22 is delineated about an inner surface 20 of the shaft body 19, and the outer shaft-diameter 23 is delineated about an outer surface 21 of the shaft body 19. More specifically, the inner shaft-diameter 22 is greater than the second outer diameter 14 so that the second tail section 13 can be fully inserted into the shaft body 19. The inner shaft-diameter 22 is smaller than the first outer diameter 12 so that the first tail section 11 can be externally positioned and pressed against the shaft body 19. Furthermore, the outer shaft-diameter 23 is equal or slightly smaller than to the first outer diameter 12 thus ensuring seamless movement of the sleeve 1 from the shaft body 19 to first tail section 11.

In reference to FIG. 3 and FIG. 7, the present invention may further comprise an inner sleeve-diameter 6 and an outer sleeve-diameter 7. The inner sleeve-diameter 6 is delineated about an inner surface 4 of the sleeve 1, and the outer sleeve-diameter 7 is delineated about an outer surface 5 of the sleeve 1. More specifically, the inner sleeve-diameter 6 is greater than the first outer diameter 12 and the second outer diameter 14 so that sleeve 1 can be radially and externally positioned around the first tail section 11 and the shaft body 19. The inner sleeve-diameter 6 is smaller than the third outer diameter 10 to ensure that the sleeve 1 stops adjacent the collar section 9 and does not move pass the collar section 9. The outer sleeve-diameter 7 is equal to the third outer diameter 10 thus providing a continuous outer surface transaction from the sleeve 1 to the collar section 9.

Although the invention has been explained in relation to its preferred embodiment, it is to be understood that many other possible modifications and variations can be made without departing from the spirit and scope of the invention as hereinafter claimed.

What is claimed is:

1. A jacketed archery arrow insert system for an arrow comprising:

a sleeve;

a torque dissipation rod insert;

an arrow shaft;

the torque dissipation rod insert comprising a collar section, a first tail section, and a second tail section;

the collar section and the second tail section being oppositely positioned of each other about the first tail section;

the collar section being adjacently connected to the first tail section;

the collar section being concentrically positioned to the first tail section;

the second tail section being adjacently connected to the first tail section;

the second tail section being concentrically positioned to the first tail section;

the second tail section being internally mounted to a shaft body of the arrow shaft;

the first tail section and the collar section being externally positioned to the shaft body; and the sleeve being externally mounted around the shaft body and the first tail section.

2. The jacketed archery arrow insert system for an arrow as claimed in claim 1 comprising:
the sleeve comprising a front edge and a rear edge;
the rear edge being externally positioned around the arrow shaft;
the front edge being positioned adjacent to the collar section; and
the front edge being externally positioned around the first tail section.

3. The jacketed archery arrow insert system for an arrow as claimed in claim 1 comprising:
a screw-in point;
the arrow shaft further comprising a launching mechanism and a steering mechanism;
the launching mechanism being terminally connected to the shaft body;
the steering mechanism being externally mounted to the shaft body;
the steering mechanism being adjacently positioned to the launching mechanism;
the torque dissipation rod insert and the sleeve being oppositely positioned of the launching mechanism about the shaft body; and
the screw-in point being threadedly attached into the first tail section and the second tail section.

4. The jacketed archery arrow insert system for an arrow as claimed in claim 3 comprising:
the second tail section comprising a hollow portion, a proximal extension, and at least one distal extension;
the proximal extension being concentrically connected to the hollow portion;
the distal extension being concentrically connected to the proximal extension, opposite of the hollow portion;
the hollow portion, the proximal extension, and the distal extension being internally positioned within the shaft body; and
the screw-in point being threadedly attached into hollow portion.

5. The jacketed archery arrow insert system for an arrow as claimed in claim 1 comprising:
a first outer diameter;
a second outer diameter;
a third outer diameter;
the first outer diameter being delineated about the first tail section;
the second outer diameter being delineated about the second tail section;
the third outer diameter being delineated about the collar section;
the first outer diameter being greater than the second outer diameter; and
the third outer diameter being greater than the first outer diameter.

6. The jacketed archery arrow insert system for an arrow as claimed in claim 5 comprising:
an inner shaft-diameter;
an outer shaft-diameter;
the inner shaft-diameter being delineated about an inner surface of the shaft body;
the outer shaft-diameter being delineated about an outer surface of the shaft body;
the inner shaft-diameter being greater than the second outer diameter;
the inner shaft-diameter being smaller than the first outer diameter; and
the outer shaft-diameter being equal to the first outer diameter.

7. The jacketed archery arrow insert system for an arrow as claimed in claim 5 comprising:
an inner sleeve-diameter;
an outer sleeve-diameter;
the inner sleeve-diameter being delineated about an inner surface of the sleeve;
the outer sleeve-diameter being delineated about an outer surface of the sleeve;
the inner sleeve-diameter being greater than the first outer diameter and the second outer diameter;
the inner sleeve-diameter being smaller than the third outer diameter; and
the outer sleeve-diameter being equal to the third outer diameter.

8. A jacketed archery arrow insert system for an arrow comprising:
a sleeve;
a torque dissipation rod insert;
an arrow shaft;
the sleeve comprising a front edge and a rear edge;
the torque dissipation rod insert comprising a collar section, a first tail section, and a second tail section;
the collar section and the second tail section being oppositely positioned of each other about the first tail section;
the collar section being adjacently connected to the first tail section;
the collar section being concentrically positioned to the first tail section;
the second tail section being adjacently connected to the first tail section;
the second tail section being concentrically positioned to the first tail section;
the second tail section being internally mounted to a shaft body of the arrow shaft;
the first tail section and the collar section being externally positioned to the shaft body;
the sleeve being externally mounted around the shaft body and the first tail section;
the rear edge being externally positioned around the arrow shaft;
the front edge being positioned adjacent to the collar section; and
the front edge being externally positioned around the first tail section.

9. The jacketed archery arrow insert system for an arrow as claimed in claim 8 comprising:
a screw-in point;
the arrow shaft further comprising a launching mechanism and a steering mechanism;
the launching mechanism being terminally connected to the shaft body;
the steering mechanism being externally mounted to the shaft body;
the steering mechanism being adjacently positioned to the launching mechanism;
the torque dissipation rod insert and the sleeve being oppositely positioned of the launching mechanism about the shaft body; and
the screw-in point being threadedly attached into the first tail section and the second tail section.

10. The jacketed archery arrow insert system for an arrow as claimed in claim 9 comprising:
the second tail section comprising a hollow portion, a proximal extension, and at least one distal extension;
the proximal extension being concentrically connected to the hollow portion;

the distal extension being concentrically connected to the proximal extension, opposite of the hollow portion;

the hollow portion, the proximal extension, and the distal extension being internally positioned within the shaft body; and the screw-in point being threadedly attached into hollow portion.

11. The jacketed archery arrow insert system for an arrow as claimed in claim 8 comprising:

a first outer diameter;

a second outer diameter;

a third outer diameter;

the first outer diameter being delineated about the first tail section;

the second outer diameter being delineated about the second tail section;

the third outer diameter being delineated about the collar section;

the first outer diameter being greater than the second outer diameter; and the third outer diameter being greater than the first outer diameter.

12. The jacketed archery arrow insert system for an arrow as claimed in claim 11 comprising:

an inner shaft-diameter;

an outer shaft-diameter;

the inner shaft-diameter being delineated about an inner surface of the shaft body;

the outer shaft-diameter being delineated about an outer surface of the shaft body;

the inner shaft-diameter being greater than the second outer diameter;

the inner shaft-diameter being smaller than the first outer diameter; and the outer shaft-diameter being equal to the first outer diameter.

13. The jacketed archery arrow insert system for an arrow as claimed in claim 11 comprising:

an inner sleeve-diameter;

an outer sleeve-diameter;

the inner sleeve-diameter being delineated about an inner surface of the sleeve;

the outer sleeve-diameter being delineated about an outer surface of the sleeve;

the inner sleeve-diameter being greater than the first outer diameter and the second outer diameter;

the inner sleeve-diameter being smaller than the third outer diameter; and the outer sleeve-diameter being equal to the third outer diameter.

14. A jacketed archery arrow insert system for an arrow comprising:

a sleeve;

a torque dissipation rod insert;

an arrow shaft;

a first outer diameter;

a second outer diameter;

a third outer diameter;

the sleeve comprising a front edge and a rear edge;

the torque dissipation rod insert comprising a collar section, a first tail section, and a second tail section;

the collar section and the second tail section being oppositely positioned of each other about the first tail section;

the collar section being adjacently connected to the first tail section;

the collar section being concentrically positioned to the first tail section;

the second tail section being adjacently connected to the first tail section;

the second tail section being concentrically positioned to the first tail section;

the second tail section being internally mounted to a shaft body of the arrow shaft;

the first tail section and the collar section being externally positioned to the shaft body;

the sleeve being externally mounted around the shaft body and the first tail section;

the rear edge being externally positioned around the arrow shaft;

the front edge being positioned adjacent to the collar section;

the front edge being externally positioned around the first tail section;

the first outer diameter being delineated about the first tail section;

the second outer diameter being delineated about the second tail section;

the third outer diameter being delineated about the collar section;

the first outer diameter being greater than the second outer diameter; and the third outer diameter being greater than the first outer diameter.

15. The jacketed archery arrow insert system for an arrow as claimed in claim 14 comprising:

a screw-in point;

the arrow shaft further comprising a launching mechanism and a steering mechanism;

the launching mechanism being terminally connected to the shaft body;

the steering mechanism being externally mounted to the shaft body;

the steering mechanism being adjacently positioned to the launching mechanism;

the torque dissipation rod insert and the sleeve being oppositely positioned of the launching mechanism about the shaft body; and the screw-in point being threadedly attached into the first tail section and the second tail section.

16. The jacketed archery arrow insert system for an arrow as claimed in claim 15 comprising:

the second tail section comprising a hollow portion, a proximal extension, and at least one distal extension;

the proximal extension being concentrically connected to the hollow portion;

the distal extension being concentrically connected to the proximal extension, opposite of the hollow portion;

the hollow portion, the proximal extension, and the distal extension being internally positioned within the shaft body; and the screw-in point being threadedly attached into hollow portion.

17. The jacketed archery arrow insert system for an arrow as claimed in claim 14 comprising:

an inner shaft-diameter;

an outer shaft-diameter;

the inner shaft-diameter being delineated about an inner surface of the shaft body;

the outer shaft-diameter being delineated about an outer surface of the shaft body;

the inner shaft-diameter being greater than the second outer diameter;

the inner shaft-diameter being smaller than the first outer diameter; and the outer shaft-diameter being equal to the first outer diameter.

18. The jacketed archery arrow insert system for an arrow as claimed in claim 14 comprising:

an inner sleeve-diameter;

an outer sleeve-diameter;

the inner sleeve-diameter being delineated about an inner surface of the sleeve;

the outer sleeve-diameter being delineated about an outer surface of the sleeve;

the inner sleeve-diameter being greater than the first outer diameter and the second outer diameter;

the inner sleeve-diameter being smaller than the third outer diameter; and the outer sleeve-diameter being equal to the third outer diameter.

* * * * *